US008582791B2

(12) United States Patent
Neumeyer et al.

(10) Patent No.: US 8,582,791 B2
(45) Date of Patent: Nov. 12, 2013

(54) HEARING AID AND CIRCUIT FOR DETECTING A CONNECTOR

(75) Inventors: Frederick Charles Neumeyer, Austin, TX (US); David Matthew Landry, Austin, TX (US); Gregory Charles Yancey, Austin, TX (US)

(73) Assignee: Audiotoniq, Inc., Austin, TX (US)

( * ) Notice: Subject to any disclaimer, the term of this patent is extended or adjusted under 35 U.S.C. 154(b) by 344 days.

(21) Appl. No.: 13/081,961

(22) Filed: Apr. 7, 2011

(65) Prior Publication Data

US 2011/0249838 A1 Oct. 13, 2011

Related U.S. Application Data

(60) Provisional application No. 61/323,844, filed on Apr. 13, 2010.

(51) Int. Cl.
*H04R 25/00* (2006.01)

(52) U.S. Cl.
USPC ..... 381/314; 381/312

(58) Field of Classification Search
USPC ..... 381/312, 314, 319, 321, 323
See application file for complete search history.

(56) References Cited

U.S. PATENT DOCUMENTS

| | | | | |
|---|---|---|---|---|
| 3,144,527 | A | 9/1961 | Tolegian et al. | |
| 4,211,456 | A * | 7/1980 | Sears | 439/39 |
| 5,333,205 | A * | 7/1994 | Bogut et al. | 381/172 |
| 6,748,094 | B1 | 6/2004 | Tziviskos | |
| 7,311,526 | B2 | 12/2007 | Rohrbach et al. | |
| 7,637,746 | B2 | 12/2009 | Lindberg et al. | |
| 7,641,477 | B2 | 1/2010 | DiFonzo et al. | |
| 2002/0131614 | A1 * | 9/2002 | Jakob et al. | 381/314 |
| 2009/0129618 | A1 * | 5/2009 | Heerlein et al. | 381/328 |
| 2009/0279719 | A1 * | 11/2009 | Lesso | 381/174 |
| 2011/0019848 | A1 * | 1/2011 | Fujii et al. | 381/321 |
| 2011/0091059 | A1 * | 4/2011 | Sacha | 381/321 |

* cited by examiner

*Primary Examiner* — Brian Ensey
*Assistant Examiner* — Katherine Faley
(74) *Attorney, Agent, or Firm* — Lee & Hayes, PLLC

(57) ABSTRACT

A circuit for a hearing aid includes an interface including a contact element for receiving a connector. The interface is configured to provide produce an electrical signal when the connector contacts the contact element. The circuit further includes a logic circuit coupled to the interface for receiving the electrical signal and configured to detect the connector in response to receiving the electrical signal.

20 Claims, 7 Drawing Sheets

HEARING AID AND CIRCUIT FOR DETECTING A CONNECTOR

CROSS-REFERENCE TO RELATED APPLICATION(S)

This application is a non-provisional of and claims priority to U.S. Provisional Patent Application No. 61/323,844 filed on Apr. 13, 2010 and entitled "Attachment Detector Device," which is incorporated herein by reference in its entirety.

FIELD

This disclosure relates generally to attachment detection devices, and more particularly to circuits and devices for detecting a wired connection with the device.

BACKGROUND

Many devices include connectors for receiving a wired connection to another device. Various types of connectors can be found in the marketplace that can be configured for a particular combination of characteristics. In one instance, a design consideration for a particular connector includes circuitry to enhance the operation of the circuit with which the connector will be used. In another instance, design considerations for such connectors can include the cost, the desired reliability, the sensitivity of the connector to the environment, the ease with which the connection may be made, the expected number of cycles (connecting and disconnecting), the number of contacts required, and other considerations.

It may sometimes be important to know when a connection between two devices has been established. Some conventional connectors detect such electrical connections using a mechanical means. For example, a spring can be located at a port or other receiving interface, such that the spring is compressed when a connector is physically connected to the port.

In devices where size is an important design parameter, such as in a hearing aid, a spring-type of detector may consume too much space to be usable. Moreover, the spring may require an insertion (connection) force sufficient to compress the spring to establish the connection that may be impractical for soft tissues such as the tissues of the ear. Further, the spring represents a mechanical feature that may be prone to failure.

In some instances, circuitry can be used to detect a physical connection, such as a powered device detection circuit in a Power over Ethernet environment. However, such detection circuitry consumes power in the detection process, which power consumption is undesirable in small, portable, battery-powered devices, such as hearing aids.

BRIEF DESCRIPTION OF THE DRAWINGS

In the following description, the use of the same reference numerals in different drawings indicates similar or identical items.

DETAILED DESCRIPTION OF ILLUSTRATIVE EMBODIMENTS

Embodiments of systems and methods are described below for detecting a wired connection to a device. In an example, a hearing aid includes a connection interface with a plurality of electrical contact elements. At least one of the electrical contact elements includes first and second current electrodes, which are spaced apart from each other. The first current electrode is coupled to a power source and the second current electrode is coupled to a ground, such that when an external connector with a conductive element contacts the electrical contact location current flows between the power source and the ground. The system includes a logic circuit coupled to one of the conductive leads to detect the current and for detecting the external connector in response to detecting the current. In some instances, the logic circuit may detect the connector based on a change in a current, a voltage, a resistance, a capacitance, a complex impedance, or any combination thereof. In another instance, the logic circuit detects the connector in response to a change in an optical parameter or in response to a signal generated by a piezoelectric element. Examples of contact elements, connector contacts, and logic circuitry are described below with respect to FIGS. 1-6 that can be used to detect when a connector is physically connected to the connection interface.

Figure 1:
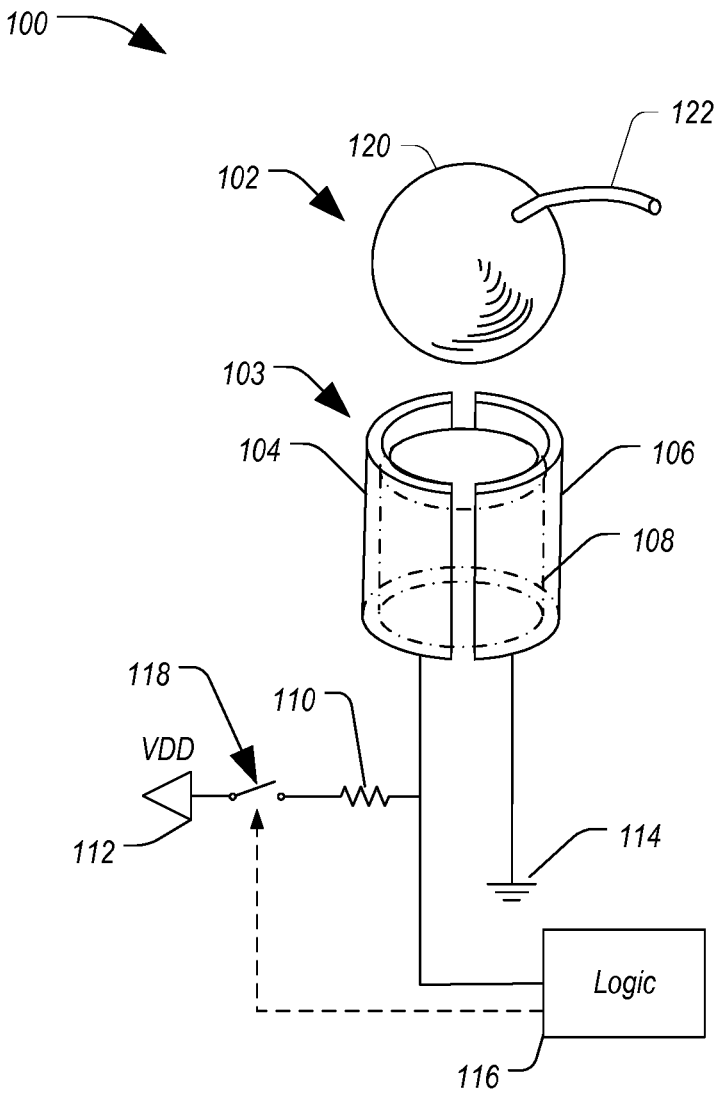
FIG. 1 is a diagram of an embodiment of a system including a logic circuit for detecting a connector based on a change in an electrical parameter.

FIG. 1 is a diagram of an embodiment of a system 100 for detecting a connector based on a change in an electrical parameter. System 100 includes a connector 102 configured to releasably contact a contact element 103. Contact element 103 includes conductive leads 104 and 106 and a magnetic element 108 disposed between conductive leads 104 and 106. Conductive lead 106 is connected to a first power supply terminal (such as ground), and conductive lead 104 is connected to a logic circuit 116 and to a first terminal of a resistor 110. Resistor 110 has a second terminal connected to a first terminal of a switch 118, which has a second terminal connected to a second power supply terminal 112 (such as VDD).

Connector 102 includes a conductive element 120 connected to a wire 122, which may include one or more conductive leads for carrying power and/or data. In this embodiment, connector 102 can conduct current between conductive leads 104 and 106 when connector 102 contacts them.

Magnetic component 108 magnetically attracts and secures conductive element 120 in contact with first and second conductive leads 104 and 106. In one embodiment, conductive element 120 is formed out of a conductive, magnetically attractive material or a conductive magnet. In some embodiments, magnetic component 108 can be a conductive magnet. In an alternative embodiment, magnetic component 108 can be implemented a magnetically attractive material, and conductive element 102 can be formed out of a conductive magnet. In still another embodiment, magnetic component 108 is a magnet, and conductive element 102 is a conductive magnet having an opposite polarity to that of the magnetic component 108.

In an example, logic circuit 116 (or a control circuit) controls switch 118 to connect power supply terminal 112 to conductive lead 104 through resistor 110, and current flows into logic circuit 116. Logic circuit 116 monitors an electrical parameter, such as current flow or a voltage across resistor 110. When conductive element 120 contacts conductive leads 104 and 106, a current path is formed between conductive leads 104 and 106, providing a short circuit from conductive lead 104 to ground 114, which produces a detectable change in the electrical parameter. Logic circuit 116 detects the change and determines that connector 102 is contacting contact element 103. In one instance, the electrical parameter is a voltage, which is at a first voltage level when connector 102 is not connected and which is at a second voltage level (i.e., ground) when connector 102 is connected to contact element 103. In response to detecting the change, logic circuit 116 controls switch 118 to disconnect the power supply terminal from the second terminal of resistor 110.

In some instances, connector 102 is configured to deliver a signal to logic circuit 116 (or to other circuitry) from a wired device, such as a portable music player (e.g., an MP3 player), a stereo, a computer, a cell or smart phone, a tablet computer, or another computing device. Connector 102 may be designed with one or more contact surfaces, where at least one of the contact surfaces is adapted to complete the circuit between the conductive leads 104 and 106.

Logic circuit 116 can perform various actions once the connection is detected. For example, if logic circuit 116 is incorporated into a hearing aid, logic circuit 116 can be configured to alter the operating mode of the hearing aid, such as to a recharge mode, an audio mode, or some other mode. In one particular example, logic circuit 116 can include a processor and an analog-to-digital converter. In another particular example, logic circuit 116 can include one or more detectors to detect a change in the electrical parameter. In the audio mode, for example, the hearing aid may switch to a dual input mode, allowing receipt of two audio inputs (one from the wired connection (such as from the conductive element 120) and one from a microphone internal to the hearing aid). Alternatively, in the audio mode, the hearing aid may switch to a direct input mode, which allows audio input only from the wired input and ignores audio signals from the microphone. In a second example, upon detecting the connection, logic circuit 116 could put the hearing aid into a recharge mode to receive power from the conductive element 120. In the recharge mode, the hearing aid places its circuitry into a low power mode, which may allow various components, such as the microphone or processor, to be turned off while the hearing aid is recharging.

Conductive leads 104 and 106 and conductive element 102 may be formed from various conductive materials and may have various shapes for receiving conductive element 120. For example, conductive leads 104 and 106 may be substantially half-cylindrical shapes and conductive element 120 may have spherical shape adapted to fit within the cylinder-shaped contact element 103 created by the adjacent conductive leads 104 and 106 as shown in FIG. 1.

In an alternative embodiment, conductive element 120 may be formed out of two materials. In this example, the first of the two materials material may be a magnetically attractive material, such as iron, but not necessarily a conductive material, which forms the interior of conductive element 120 that is attracted to the magnetic element 108. In this particular example, the second material of the two materials can be a conductive material that at least partially covers the first material to conduct current between conductive leads 104 and 106. In some instances, the second material may be formed out of different material for different types of connectors in order to vary the resistance of conductive element 120. In this manner, when conductive element 120 completes the circuit between first and second conductive leads 104 and 106, the current and/or voltage is divided between logic circuit 116 and conductive element 120. By controlling a resistance of the second material, conductive element 120 prevents a short circuit and provides a desired divider circuit for detecting connector element 120. Further, differences in resistance may be detected and used to differentiate between different types of connectors.

Logic 116 detects the voltage at the first terminal of resistor 110 and performs various actions depending on the voltage. In particular, different connectors 102 may have unique resistances, which can be used to differentiate between their functions. In an example, a first connector having a first resistance supplies power, while a second connector having a second resistance provides an audio signal, and so on. This allows the same interface to be used to receive different connectors having the same physical design but configured to perform different functions, e.g., a recharge function, an audio input function, and so on. Thus, logic circuit 116 determines what type of device is connected to the interface that includes the contact element 103. For example, if system 100 is a hearing aid system, conductive element 120 having a first resistance may be a connector for a power source in one instance, and a conductive element 120 having a second resistance may be a connector of an audio source. If the resistance of conductive element 120 for the power source is different than the resistance of the conductive element 120 of the audio source, logic circuit 116 can easily determine which type of device is connected and set the operating mode of the hearing aid accordingly.

In addition to setting the operating mode of the hearing aid, logic circuit 116 is also able to send control signals, data, or power back through conductive element 120 to external connector 102. For example if external connector 102 is a power source, logic circuit 116 may send a control signal to a processor in the power source including the current power state of the hearing aid. In another example the external connector 102 may be a data storage device and logic circuit 116 may provide system setting information for review by a specialist, such as a hearing health professional.

System 100 is one possible embodiment of a device including logic to detect a connection to an external connector 102 based on a change in voltage. However, such connections may also be detected based on other parameters. For example, some circuits may detect the connection based on a change in current, voltage, capacitance, complex impedance, or other electrical parameters. Another possible example of a circuit configured to detect a change in an electrical parameter is described below with respect to FIG. 2.

Figure 2:
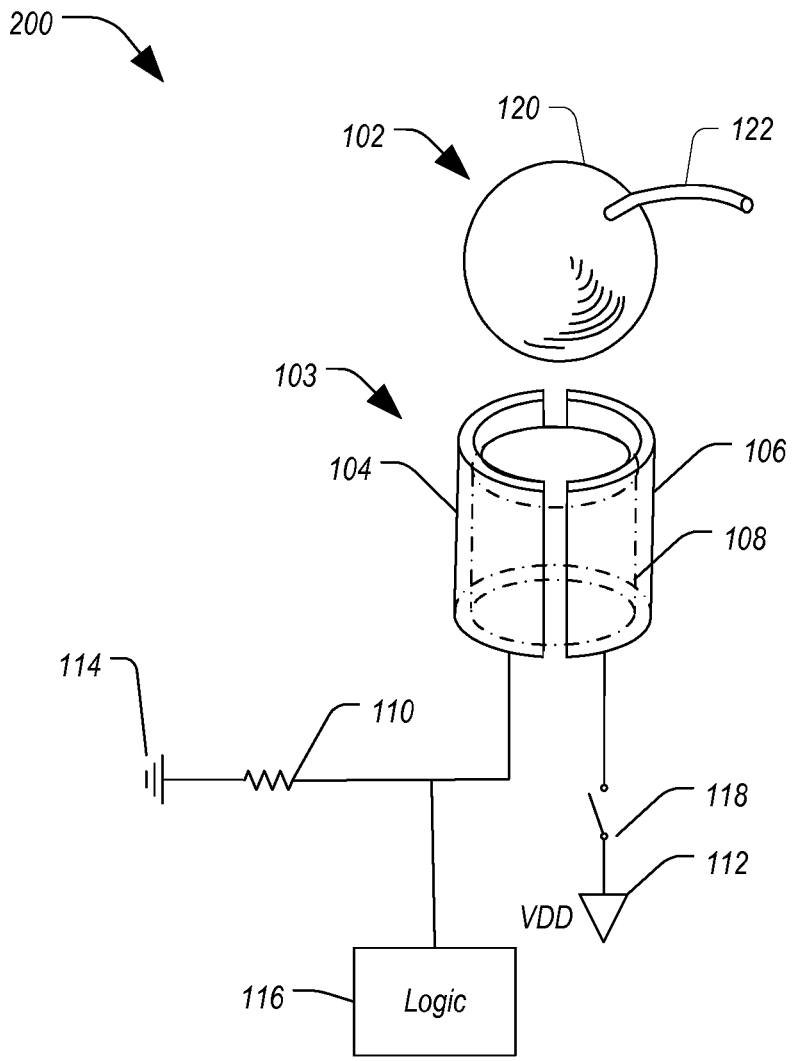
FIG. 2 is a diagram of a second embodiment of a system including a logic circuit for detecting a connector based on a change in an electrical parameter.

FIG. 2 is a diagram of a second embodiment of a system 200 including a logic circuit 116 for detecting a connector based on a change in an electrical parameter. Contact element 103 includes conductive leads 104 and 106 connected to logic circuit 116 to detect a change in current flow or voltage when conductive element 120 of external connector 102 contacts the contact element 103. Conductive lead 104 is connected to a first terminal of resistor 110, which has a second terminal connected to a first power supply terminal 114, such as ground. Logic circuit 116 is connected to the first terminal of resistor 110 and to conductive lead 104. Conductive lead 206 is connected to a first terminal of switch 118, which has a second terminal connected to a second power supply terminal 112, such as VDD. Further, contact element 103 includes a magnet 108 between conductive leads 104 and 106.

In an example, logic circuit 116 may control operation of switch 118. When switch 118 is closed connecting second power supply terminal 212 to conductive lead 106, no current flows from contact element 103 to logic circuit 116. However, when conductive element 120 contacts conductive leads 104 and 106, current flows from second power supply terminal 212 through conductive lead 106, conductive element 120 and conductive lead 104 to logic circuit 116 and to the first terminal of resistor 110. Logic circuit 116 detects a change in current flowing to ground 214. In some instances, logic 216 detects the change as a change in voltage across resistor 210. After detecting the connection, logic 216 can operate as discussed above with respect to logic 116 to perform a variety of functions, including, for example, altering an operating mode of a device, such as a hearing aid.

While FIGS. 1 and 2 depict systems 100 and 200, respectively, configured to detect when a connection is made based on a change in voltage, other detection techniques are also possible. One possible example of a system to detect a connection based on a change in capacitance is depicted and described with respect to FIG. 3.

Figure 3:
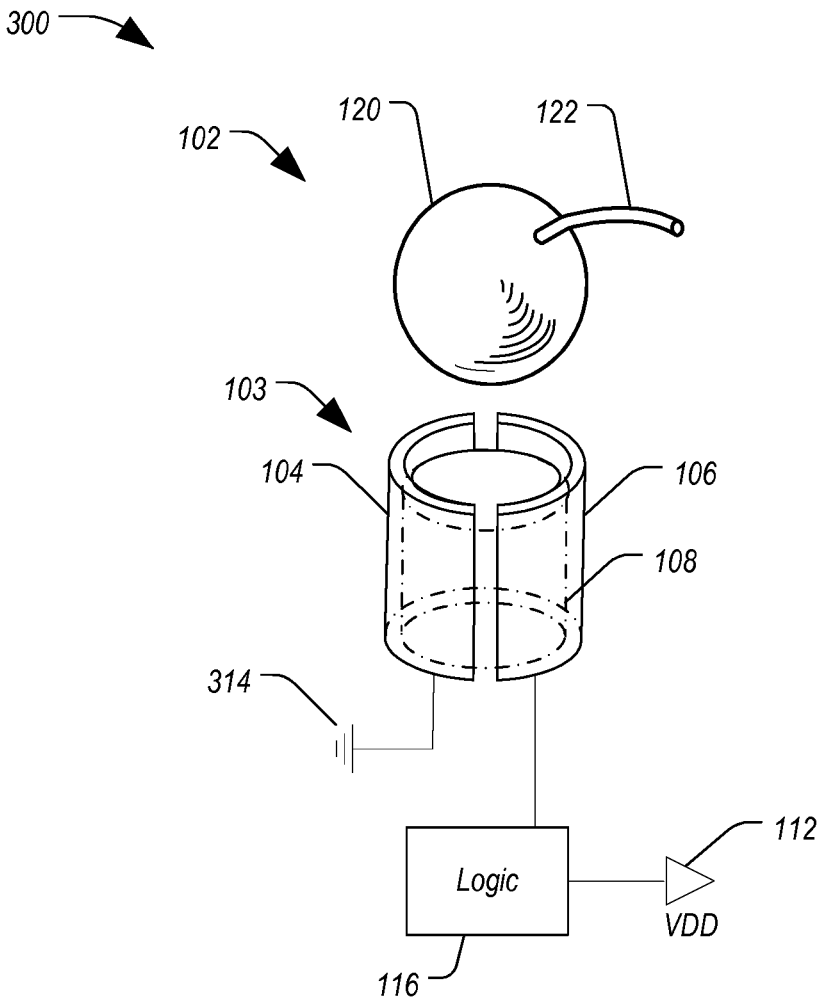
FIG. 3 is a diagram of a third embodiment of a system including a logic circuit for detecting a connector based on a change in a capacitance.

FIG. 3 is a block diagram of a third embodiment of a system 300 including a logic circuit 116 for detecting a connector based on a change in a capacitance. In the illustrated example, contact element 103 includes conductors 104 and 106 spaced apart by a dielectric. At least one of the conductors 104 and 106 is connected to logic circuit 106, which is configured to detect a capacitive change when a conductive element 120 of external connector 102 contacts conductors 104 and 106. In the illustrated example, conductive lead 104 is connected to a first power supply terminal 314 (ground) and conductive lead 106 is connected to logic circuit 116. Contact element 103 further includes a magnet 108 to attract and secure connector 120.

Conductive leads 104 and 106 form a capacitor. Logic 116 is configured to detect a change in capacitance when conductive element 102 is positioned proximate to conductive lead 104 and 106. In particular, proximity of conductive element 102 relative to conductive leads 104 and 106 produces a secondary capacitance between conductive element 102 and each of the conductive leads 104 and 106. The secondary capacitance alters the capacitance of conductive leads 104 and 106, producing a detectable change, which logic 116 is configured to detect. The effective capacitance of conductive leads 104 and 106 may continue to change until conductive element 102 contacts conductive leads 104 and 106. In this embodiment, conductive element 102 may include a conductive core with a non-conductive surface coating that is configured to alter a capacitance between conductive leads 104 and 106.

In another embodiment, logic 316 is configured to detect a change in current. In this embodiment, logic 316 includes a transistor (not shown), such as a MOSFET, vacuum tube, BJT, or PMOS. In this embodiment, when conductive element 302 is placed within the contact element 103, power from VDD 112 flows through logic 116 to the conductive element 102. However, when conductive element 102 is not connected to contact element 103, the capacitance between conductive leads 104 and 106 remains substantially static such that no current flows through logic 116 from VDD 112.

Logic 116 performs various actions as a result of detecting the current flow, such as those described above with respect to logic 116 depicted in FIG. 1. For example, logic 116 may adjust an operating mode of a device, such as a hearing aid in response to detecting a change in the capacitance between conductive leads 104 and 106 of contact element 103. While FIGS. 1-3 depict a system for detecting connection using conductive electrodes in a non-contact relation, other types of circuit arrangements can also be used to detect the connector. One possible example of a system that uses a single conductive electrode is described below with respect to FIG. 4 below.

Figure 4:
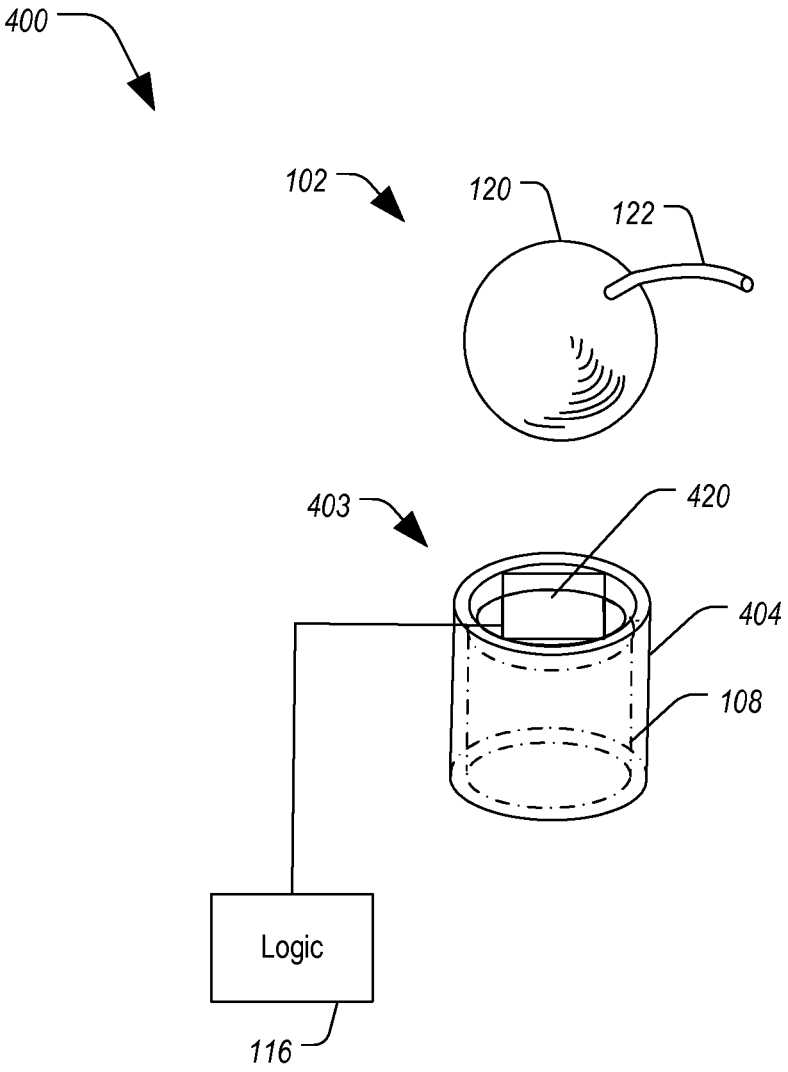
FIG. 4 is a diagram of a fourth embodiment of a system including a logic circuit for detecting a connector using a piezoelectric element.

FIG. 4 is a diagram of a fourth embodiment of a system 400 including logic circuit 116 for detecting a connector 120 using a piezoelectric element 420. System 400 includes a contact element 403 having a substantially cylindrically-shaped electrode 404 and piezoelectric element 420 disposed therein. System 400 further includes an external element 102 associated with external connector 120. System 400 further includes a magnet 108 associated with contact element 403. Additionally, system 400 includes a logic circuit 116 connected to piezoelectric element 420.

In one example, contact element 403 receives external element 102, causing deflection (flexing) of piezoelectric element 420, which generates an electrical signal. Logic circuit 116 detects the electrical signal indicating contact between external element 102 and contact element 403. In response to the electrical signal, logic 116 perform various actions, including disambiguating the detected contact to determine whether the contact is a "false positive" or if a valid connection to external connector 102 has been established. Further, logic 116 can perform other operations, such as those described above with respect to FIGS. 1-3.

While FIGS. 1-4 depict systems 100, 200, 300, and 400, respectively, for detecting a connection to external connector 102, other types of detection systems may also be used. For example, an optical sensor could be used to detect a change in a light signal. One possible example of a system including a light emitting diode and a light detector is described below with respect to FIG. 5.

Figure 5:
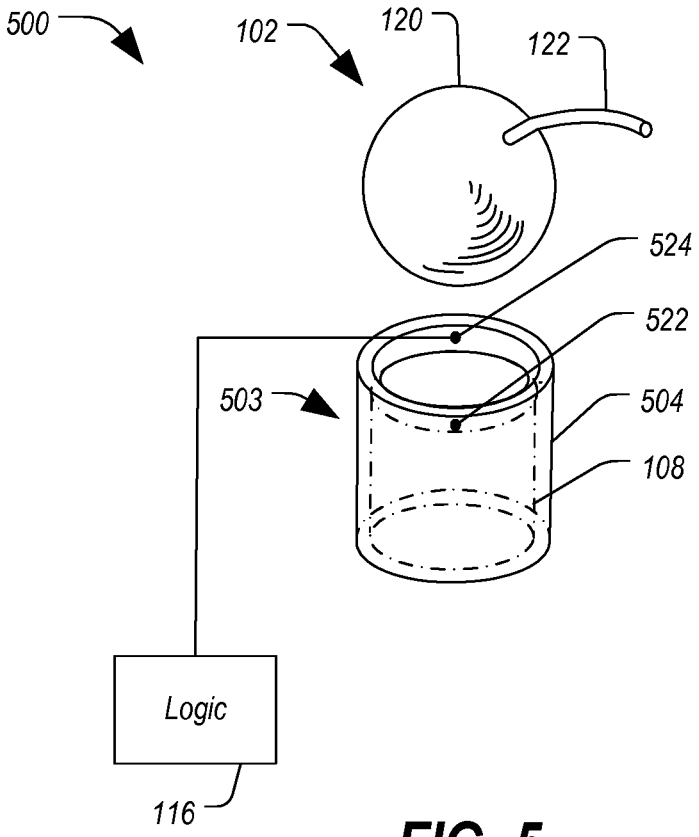
FIG. 5 is a diagram of a fifth embodiment of a system including a logic circuit for detecting a connector based on a change in an optical parameter.

FIG. 5 is a diagram of a fifth embodiment of a system 500 including a logic circuit 116 for detecting a connector based on a change in an optical parameter. System 500 includes logic 116 coupled to a light detector 524 and optionally to a light emitting diode 522. In some instances, system 500 includes a magnet 508 to attract and secure external connector 102 in physical contact with a cylindrical wall 504 of contact element 503.

In an example, light emitting diode 522 generates a light signal, which is received by light detector 524. When contact element 503 receives external connector 102, the light signal from light emitting diode 522 is obstructed, and light detector 524 detects the obstruction (i.e., the absence of the light signal) and communicates data related to the obstruction to logic circuit 116. The position of light-emitting diode 522 and light detector 524 is such that external connector 102 obstructs the light signal when the external connector 102 is in electrical communication with contact element 503.

In response to detecting the change, logic circuit 116 performs various actions, including those described above with respect to the logic circuits of FIGS. 1-4. Another example of a system configured to detect a connector based on an electrical parameter is described below with respect to FIG. 6.

Figure 6:
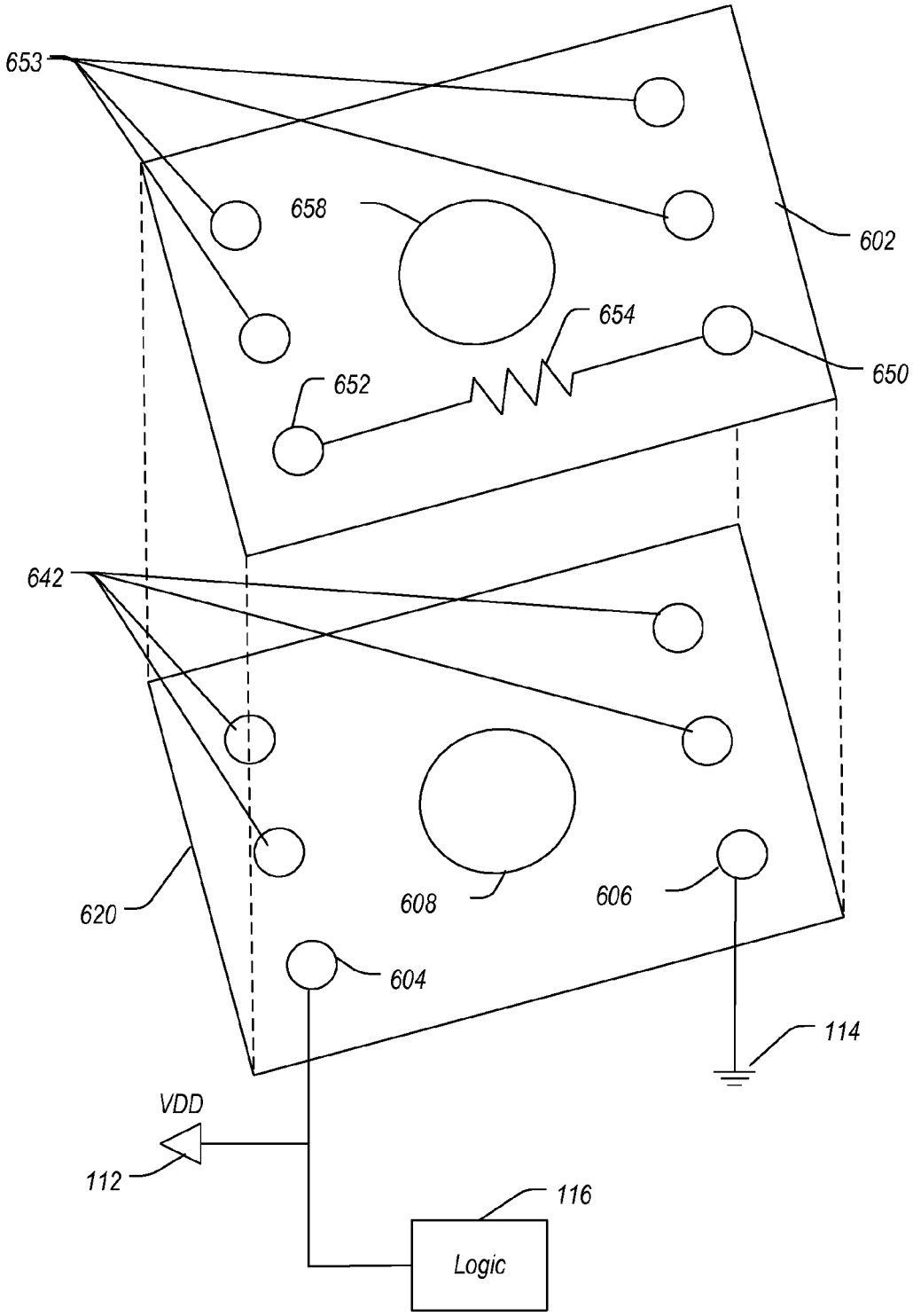
FIG. 6 is a diagram of a sixth embodiment of a system including a logic circuit for detecting a connector based on a change in an electrical parameter.

FIG. 6 is a diagram of a sixth embodiment of a system 600 including logic circuit 116 for detecting a connector based on a change in an electrical parameter. System 600 includes a contact element 620 having a plurality of conductive leads 642. Contact element 620 includes conductive lead 604 coupled to a power supply terminal 112 and to logic circuit 116 and conductive lead 606 coupled to ground 114. Contact element 620 further includes a magnetic element 608.

External connector 602 includes conductive leads 650, 652, and 653 arranged in a configuration to mate with corresponding conductive leads 606, 604, and 642 of contact element 620. External connector 602 is configured to couple to contact element 620. In the illustrated embodiment, external connector 602 includes a magnetically attractive element 658 (which may be formed from a magnetic material having a polarity opposite to a polarity of magnetic element 608. Alternatively, magnetically attractive element 658 may be formed from a magnetically attractive material. Magnetically attractive element 658 is configured to magnetically couple to magnetic element 608. External connector 602 further includes a plurality of conductive leads 652 configured to align with conductive leads 642 of contact element 620. External connector 602 has two additional conductive leads 650 and 652 and a resistor 654 having a first terminal connected to conductive lead 650 and a second terminal connected to conductive lead 652. Conductive leads 650 and 652 are configured to align with conductive leads 606 and 604, respectively. The resistance of resistor 654 may be varied depending on the intended function of external connector 602.

In an example, logic circuit 116 is configured to detect a change in current flow (or voltage) when conductive element 652 and 650 of external connector 602 contacts the conductive leads 604 and 606 of contact element 620. In response to detecting a change in an electrical parameter, logic circuit 116 determines that connector 102 is in contact with contact element 103. Based on this determination, logic circuit 116 can alter an operating mode of an electronic device, such as a hearing aid, as mentioned above with respect to FIGS. 1-5.

In an embodiment, external connector 602 is connected to contact element 620 and held firmly in place by a magnetic attraction between magnetic element 608 and magnetically attractive element 658. Plurality of conductive leads 642 are thus coupled to plurality of conductive leads 652 and conductive leads 604 and 606 are coupled to conductive leads 652 and 650, respectively completing a circuit between power supply terminal 612 and ground 614.

Logic circuit 116 monitors a current at a node coupled to the power supply terminal (for example) or a voltage across a resistor to detect the change in the electrical parameter. When, contact leads 650 and 652 contact conductive leads 606 and 604, respectively, a current path is formed allowing current to flow from power supply terminal 112 to ground 114. Logic circuit 116 detects the change in an electrical parameter to determine that a connection had been made.

In some embodiments, resistor 654 is incorporated into external connector 602 between conductive leads 652 and 650 changing the voltage detected by logic circuit 116 at the voltage divide. In this embodiment, logic circuit 116 can determine what type of function external connector 602 is designed to perform because the voltage at the voltage divided is varied by the resistance of resistor 654. In response to determining the function of external connector 602, logic circuit 116 is able to alter the operating mode of system 600.

In some instances the physical circuitry of system 600 must be switched when the operating mode is altered the circuitry required by system 600 for performing various functions associated with external connector 602 are often incompatible with each other. For example, the circuitry required to perform a recharge is often incompatible with the circuitry required to process an audio signal. By including resistor 654 in external connector 602 between conductive leads 652 and 650, logic circuit 116 can be configured to switch between multiple sets of circuitry after determining the function indicated by resistor 654. Switching circuitry and/or operating mode of system 600 allow a single multi-use connection interface to function as multiple connection interfaces.

FIGS. 1-6 disclose systems which can be used for detecting contact between a connection interface and an external connector. One example of a device with which such systems may be used is described below with respect to FIG. 7.

Figure 7:
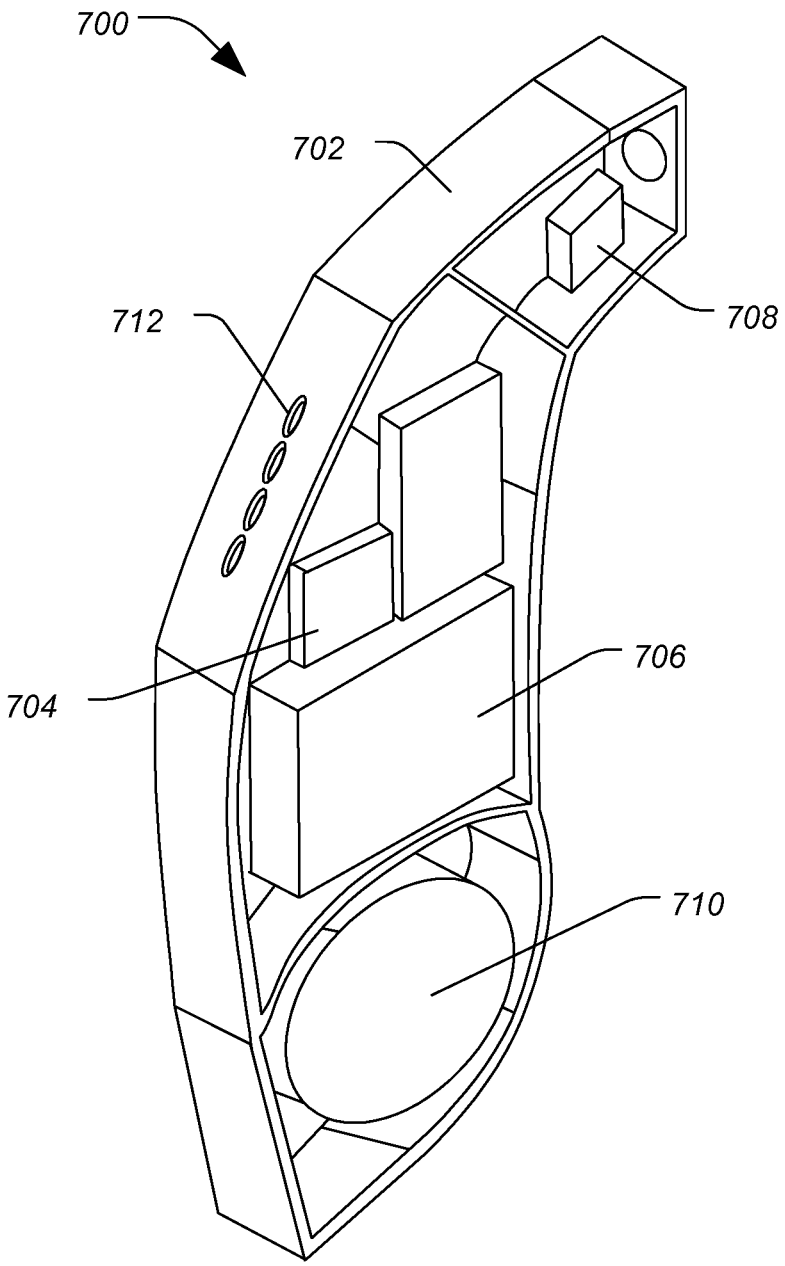
FIG. 7 is a perspective view of a representative embodiment of an external hearing aid including a connection interface having multiple contact elements and a circuit for detecting a connector, such as the logic circuitry and other elements depicted in FIGS. 1-6.

FIG. 7 is a perspective view of one possible representative embodiment of an external hearing aid 700 adapted to utilize the wired connection detector system, such as the systems 100, 200, 300, 400, 500, and 600 described above with respect to FIGS. 1-6. Hearing aid 700 includes a housing 702 defining a cavity sized to secure hearing aid circuitry. Hearing aid 700 includes a connection interface 712 including connection detection circuitry, such as the circuitry depicted with respect to systems 100, 200, 300, 400, 500, and 600 in FIGS. 1-6, respectively. Connection interface 712 is connected to a battery 710 and to a processor 706. Hearing aid 700 further includes microphone 704 connected to processor 706, and includes a speaker 708 coupled to processor 706 and configured to communicate audio data through an ear canal tube to an ear piece, which may be positioned within the ear canal of a user. Processor 706 includes the logic, such as logic 116 depicted in FIGS. 1-6, respectively. Processor 706 can detect contact between an external connector and connection interface 712.

In one embodiment, microphone 704 converts sounds into electrical signals and provides the electrical signals to signal processor 706, which processes the electrical signals according to a shaping algorithm customized to the user's hearing loss to produce a modified output signal. The modified output signal is provided to speaker 708, which reproduces the modified output signal as an audio signal. The audio signal is provided to a speaker for reproduction for a user as audible sound.

When an external connector is coupled to connection interface 712, processor 706 detects the connection and can implement a variety of operating modes. For example, processor 706 can switch the operating mode of hearing aid 700 into a direct audio mode of operation, where audio is received from the external connector through connection interface 712 instead of from microphone 704 and is shaped and directed to the user through speaker 708. In this example, hearing aid 700 can be used as a headphone for a music player, for example. In some embodiments microphone 704 can be turned off, reducing power consumption.

In alternative embodiments, upon detecting the external connector, processor 706 may alter an operating mode of hearing aid 700 to provide a dual input mode, in which case processor 706 can take audio input from both the external connector and microphone 704, combine, and shape them to compensate for the user's hearing impairment before providing the signal to speaker 708. In some instances, hearing aid 700 may apply different sound-shaping algorithms to the two signals and/or apply different gain factors. For example, processor 706 delivers audio received from the external connector at full volume and audio from microphone 604 at a reduced volume. Alternatively, processor 706 applies different sound shaping algorithms to the audio signal from microphone 704 as compared to the audio signal received from the external connector through connection interface 712.

It should be understood that, while the embodiment of hearing aid 700 illustrates an external "wrap-around" hearing device, the user-configurable signal processor 706 and the logic circuit 116 to detect the external connector can be incorporated in other types of hearing aids, including hearing aids designed to be worn behind the ear or within the ear canal, or hearing aids designed for implantation. The embodiment 700 of hearing aid 702 represents only one of many possible implementations of systems 100, 200, 300, 400, 500, and 600 depicted in FIGS. 1-6, respectively, can be utilized.

In conjunction with the hearing aids, systems, and methods discussed above with respect to FIGS. 1-7, circuitry includes at least one electrode associated with a contact element for receiving a connector and a logic circuit coupled to the at least one electrode for detecting the connector based on a change in an electrical or optical parameter. In response to detecting the change, the logic circuit may open a switch to disconnect a power supply, change an operating mode of the device, and so on. While the above-described embodiments utilized substantially cylindrically-shaped elements having substantially circular openings for receiving the connectors, it is also possible to use other shapes, which may assist a user in properly orienting a particular connector to the contact element. For example, the contact elements may have a substantially circular opening, a rectangular opening, a triangular opening, or an opening with a different shape, and the connector may have a corresponding shape.

Although the present invention has been described with reference to preferred embodiments, workers skilled in the art will recognize that changes may be made in form and detail without departing from the scope of the invention.

What is claimed is:

1. A circuit for a hearing aid, the circuit comprising:

an interface recessed into a housing of the hearing aid and including a plurality of contact elements for releasably coupling to a connector, at least one of the plurality of contact elements includes a first conductive lead spaced apart from a second conductive lead and is configured to produce an electrical signal when the connector contacts the at least one contact element and wherein the connector is configured to electrically couple the hearing aid with a remote electronic device when the connector is in contact with the interface to enable the hearing aid to receive at least one of a power supply or an audio signal;

a first power supply terminal;

a logic circuit coupled to the interface for receiving the electrical signal and configured to detect the connector in response to receiving the electrical signal via the interface; and a switch including a first electrode connected to the first power supply terminal, a second electrode coupled to the first conductive lead, and a control terminal responsive to at least one of the logic circuit and a control circuit.

2. The circuit of claim 1, wherein the interface further comprises a magnetic element configured to attract and secure the connector in contact with the contact element.

3. The circuit of claim 1, wherein:

the electrical signal comprises a voltage; and the logic circuit determines a function associated with the connector based on a resistance of the connector inferred from the voltage and sets an operating mode of the hearing aid based on the resistance.

4. The circuit of claim 1, further comprising:

a second power supply terminal coupled to the second conductive lead;

a resistor including a first terminal coupled to the logic circuit and including a second terminal, wherein the resistor is placed in a path between the second electrode of the switch and the first conductive lead such that the second electrode of the switch is coupled to the second terminal of the resistor and the first conductive lead is coupled to the first terminal of the resistor;

wherein the electrical signal comprises a voltage at the first terminal of the resistor; and wherein the control terminal of the switch controls a state of the switch based on a control signal generated by at least one of the logic circuit and the control circuit.

5. The circuit of claim 1, wherein the first conductive lead is spaced apart from the second conductive lead by a dielectric.

6. The circuit of claim 5, further comprising:

a second power supply terminal;

a resistor including a first terminal coupled to the second conductive lead and to the logic circuit and including a second terminal coupled to the second power supply terminal; and wherein the electrical signal comprises a voltage at the first terminal of the resistor.

7. The circuit of claim 5, further comprising:

a second power supply terminal coupled to the second conductive lead;

wherein the logic circuit is placed in a path between the first electrode of the switch and the first conductive lead; and wherein the electrical signal comprises a voltage at the first terminal.

8. A circuit for a hearing aid comprising:

a connection interface recessed into the housing of the hearing aid and comprising at least a first contact element and a second contact element, and wherein the first contact element includes a first conductive lead and the second contact element includes a second conductive lead;

a first power supply terminal;

a logic circuit coupled to the first conductive lead and configured to detect when a connector electrically engages the connection interface based on a change in an electrical parameter associated with the first conductive lead, the connector configured to provide the hearing aid at least one of a power supply or an audio signal when engaged to the connection interface; and a switch including a first electrode connected to the first power supply terminal, a second electrode coupled to the first conductive lead, and a control terminal responsive to the logic circuit.

9. The circuit of claim 8, wherein the connection interface further comprises a magnetic element configured to attract and secure the connector in contact with the first and second conductive leads.

10. The circuit of claim 8, wherein the logic circuit includes an output coupled to a processor of the hearing aid.

11. The circuit of claim 10, wherein the processor is configured to change an operating parameter of the hearing aid in response to the logic circuit detecting the change.

12. The circuit of claim 8, wherein the first conductive lead is electrically coupled to the second conductive lead through the connector.

13. The circuit of claim 8, wherein:

the electrical parameter comprises a voltage; and the logic circuit determines a function associated with the connector based on a resistance of the connector inferred from the voltage and sets an operating mode of the hearing aid based on the resistance.

14. The circuit of claim 8, wherein:

the electrical parameter comprises a voltage; and the logic circuit determines a function associated with the connector based on a resistance of the connector inferred from the voltage and sends a signal to the connector based on the resistance.

15. The circuit of claim 8, further comprising:

a piezoelectric element coupled to the first conductive lead and positioned between the first and second conductive leads, the piezoelectric element configured to flex when the connector contacts the first and second conductive leads to produce an electrical signal; and wherein the logic circuit detects the electrical signal as the change in the electrical parameter associated with the first conductive lead.

16. The circuit of claim 8, wherein:

the first and second conductive lead are spaced apart by a dielectric; and the change comprises a change in capacitance caused by proximity of the connector to the first and second conductive leads.

17. The circuit of claim 8, wherein:

the electrical parameter comprises a current; and the logic circuit detects the change based on a variation of an amplitude of the current.

18. A hearing aid comprising:

a microphone to convert sound into electrical signals;

a power supply terminal;

a processor coupled to the microphone and configured to process the electrical signals to produce a modulated output signal that compensates for a hearing impairment of a user;

a connection interface coupled to the processor and configured to releasably couple to an external connector, the external connector configured to provide the hearing aid at least one of a power supply or the electrical signal when coupled to the connection interface, the connection interface including at least a first and a second conductive lead;

a logic circuit coupled to the connection interface and to the processor, the logic circuit configured to detect a change in an electrical parameter when the external connector contacts the connection interface and to provide a signal to the processor in response to detecting the change; and a switch including a first electrode connected to the power supply terminal, a second electrode coupled to the first conductive lead, and a control terminal responsive to a logic circuit.

19. The hearing aid of claim 18, wherein the processor is configured to modify an operational parameter of the hearing aid in response to receiving the signal.

20. The hearing aid of claim 18, further comprising a magnetic element coupled to the connection interface to secure the connector to the connection interface.

* * * * *